US005080329A

United States Patent [19]

Dabney

[11] Patent Number: 5,080,329

[45] Date of Patent: Jan. 14, 1992

[54] SPRING LOADED LOCKING SYSTEM FOR BOX SPRING ASSEMBLIES

[75] Inventor: Upton R. Dabney, Georgetown, Ky.

[73] Assignee: Hoover Group, Inc., Alpharetta, Ga.

[21] Appl. No.: 522,600

[22] Filed: May 14, 1990

[51] Int. Cl.[5] ..... A47C 23/02

[52] U.S. Cl. ..... 267/103; 5/267; 5/270; 267/106

[58] Field of Search ..... 267/103, 105, 106, 179; 5/257, 267-277

[56] References Cited

U.S. PATENT DOCUMENTS

| | | | |
|---|---|---|---|
| 1,882,427 | 10/1932 | Kiwi | 5/267 |
| 1,964,950 | 7/1934 | Karr | 5/267 |
| 2,058,462 | 10/1936 | Karr | 5/270 |
| 3,789,440 | 2/1974 | Garceau | 5/267 |
| 4,004,304 | 1/1977 | Kane | 5/267 |
| 4,068,330 | 1/1978 | Rakow et al. | 5/267 |
| 4,736,933 | 4/1988 | Hagemeister | 267/103 |
| 4,778,157 | 10/1988 | Thomas | 267/103 |
| 4,921,228 | 5/1990 | Lowe | 267/103 |

*Primary Examiner*—Matthew C. Graham
*Attorney, Agent, or Firm*—Harness, Dickey & Pierce

[57] ABSTRACT

A spring loaded locking system for a box spring assembly having a generally rectangular frame, a plurality of spring modules and a grid type wire support deck disposed a predetermined distance above the frame. The locking system provides an interference fit which secures the spring modules to the support deck. Each spring has a pair of outwardly open V-shaped sections integrally formed with the upper portion of the spring. The vertices of the V-shaped sections commonly contact one wire of the support deck. A pair of legs extends from each vertex and straddle the common wire and either cross one of a pair of parallel brace wires of the support deck. The V-shaped sections are biased apart from each other by the shape of the upper portion of the spring module itself. The interaction between the vertices and the common wire, between the legs and the brace wires, and the outward bias of the upper portion of the spring module provides an interference lock fit which secures the support deck to the spring module.

17 Claims, 5 Drawing Sheets

SPRING LOADED LOCKING SYSTEM FOR BOX SPRING ASSEMBLIES

BACKGROUND AND SUMMARY OF THE INVENTION

The present invention relates generally to the field of mattress support foundations and more particularly to a spring loaded locking system for a box spring assembly which enables a mattress support deck to be secured in position by the individual spring modules of the assembly. The arrangement of the uppermost portion of each spring allows the locking system to form an interference fit with a pair of parallel brace wires and a connecting wire extending transversely therebetween.

While box spring assemblies are known to exist in a variety of styles, each assembly is generally constructed out of three main components, including a frame, spring modules and a mattress support deck supported above the frame by the spring modules. In securing the support deck to the spring modules various methods have been devised to decrease both production time and material cost. Originally, spring modules were secured to the mattress support deck by a variety of clips encircling both an upper portion of the spring module and a member of the grid network of the support deck.

Drawbacks have been found to exist in the previous support deck securement methods, including the following: the high number of parts required for securement (i.e. four clips per spring module); the length of time required to install each spring module; the number of wires required for the grid network; specialized forming requirements of various portions of the grid network; and weld fatigue and subsequent breakage in a welded grid network.

It is therefore an object of the present invention to decrease the number of components required in the production of a box spring assembly.

Another object of the present invention is to decrease the production time required in securing a spring module to the support deck.

It is a further object of the invention to minimize weld fatigue and subsequent breakage of weld sections.

The present invention also has as an objective a box spring assembly wherein a variable number of spring patterns may be incorporated into a common support deck.

It is also an object of the invention to eliminate spring noise created by spring to spring contact within the assembly.

The present invention provides for a spring module having a novel upper portion which utilizes the properties and shape of the spring itself to create an interference locking fit between the upper portion of the spring and the support deck. Each spring module consists of a pair of outwardly directed V-shaped sections integrally formed with the upper portion of the spring module. The vertices of the V-shaped sections may be formed so as to project either upward or downward of the upper section of the spring. A pair of legs extend either upwardly or downwardly away from the vertices until merging with the upper portion of the spring module. When properly positioned onto a support deck, the vertex of each V-section will contact a single connecting wire of the grid network. The wider legs of the V-sections then slope, either upward or downward, so as to straddle the connecting wire and cross, either beneath or above, one of a pair of parallel brace wires.

The length and shape of the upper portion of the spring module provides a sufficient locking force to wedge the V-sections in place, using a principle similar to a taper lock. To secure the support deck in this manner, each spring module requires a pair of parallel brace wires and a transversely positioned connecting wire.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE DRAWINGS

Figure 1:
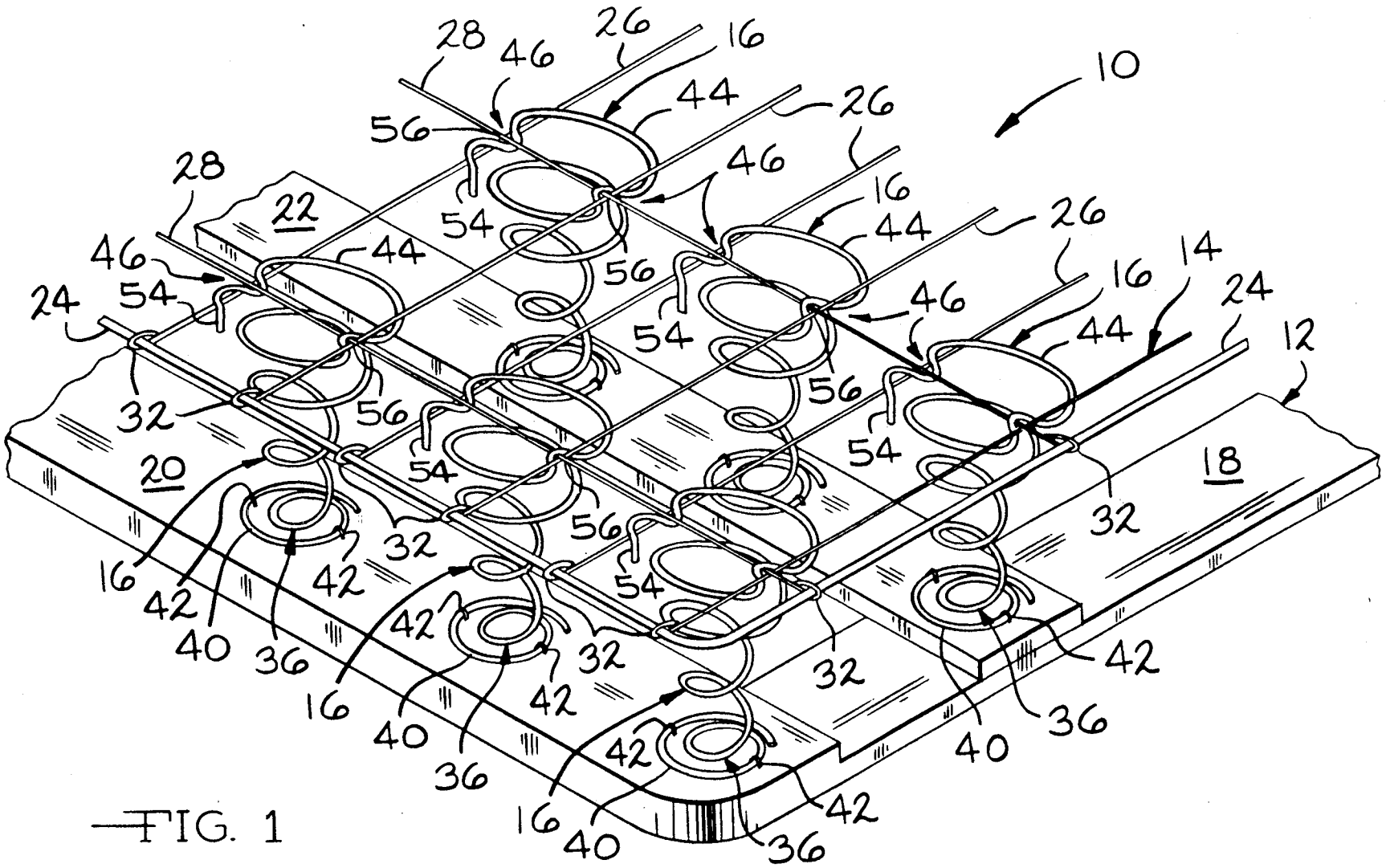
FIG. 1 is a perspective view of a portion of a box spring assembly incorporating the principles of the present invention.

Now with reference to the drawing, FIG. 1 shows a box spring assembly 10 constructed according to the principles of the present invention. The assembly 10 generally consists of a rectangular horizontal frame 12, a mattress support deck 14 and a plurality of spring modules 16.

The frame 12 is constructed having a pair of side rails 18, a pair of end rails 20 and a number of cross rails 22. The end rails 20 and the cross rails 22 are spaced apart, in a substantially parallel fashion, along the length of the side rails 18. Both the end rails 20 and cross rails 22 are positioned so that their ends overlap the side rails 18 and allow them to lie generally in the same plane.

The mattress support deck 14 is disposed a predetermined distance above the frame 12. Vertically aligned with the perimeter of the frame 12 and defining the boundary of the support deck 14 is a border wire 24. Extending lengthwise of the border wire 24 are a plurality of generally parallel long wires 26. Extending crosswise of the long wires 26 are a plurality of generally parallel cross wires 28, each aligned substantially vertically with either a cross rail 22 or an end rail 20. The ends of the long wires 26 and cross wires 28 may be secured to the border wire 24 by various means including wrap around portions 32 or clips 34. Together, the cross wires 28 and the long wires 26 form a grid network enclosed within the border wire 24.

At the juncture or crossing point 56 of the long wires 26 and cross wires 28, the two are secured together by welding or other conventionally known means. When so done, the criss-cross network of the support deck 14 is commonly referred to as a welded wire grid.

Figure 6:
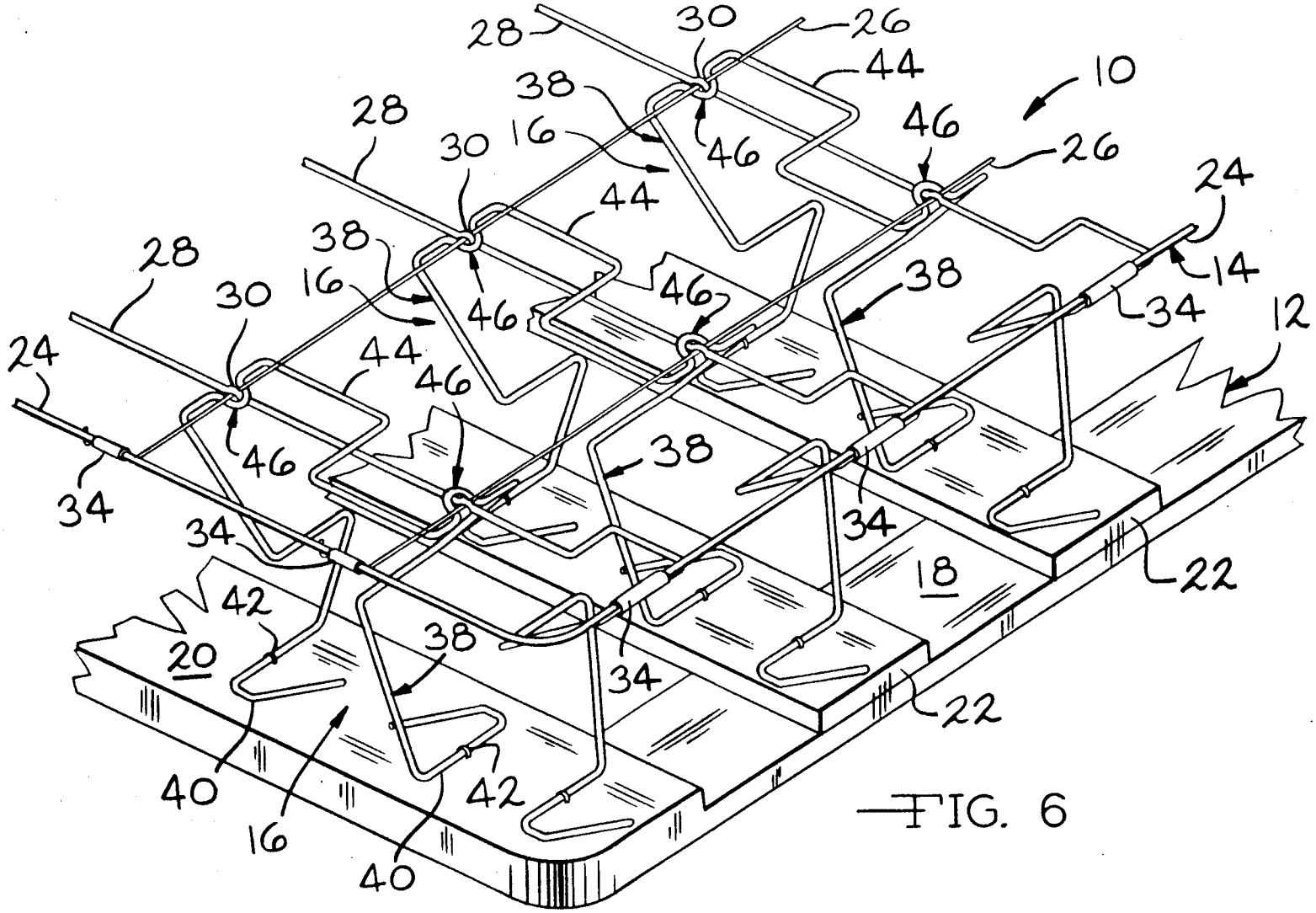
FIG. 6 is a perspective view of a portion of a box spring assembly incorporating the present invention into a square top spring module.
Figure 7:
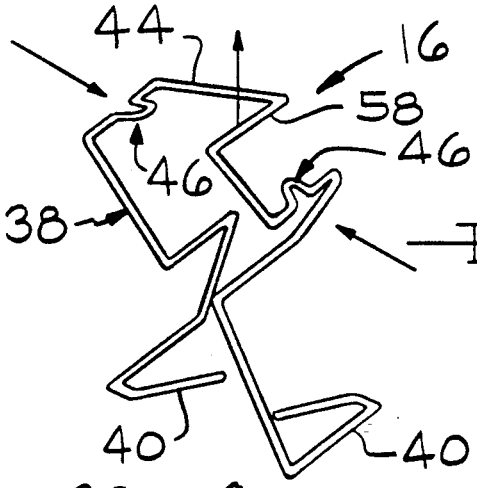
FIG. 7, 8 and 9 display the method of installing the square top spring module embodiment of the present invention into a box spring assembly.
Figure 8:
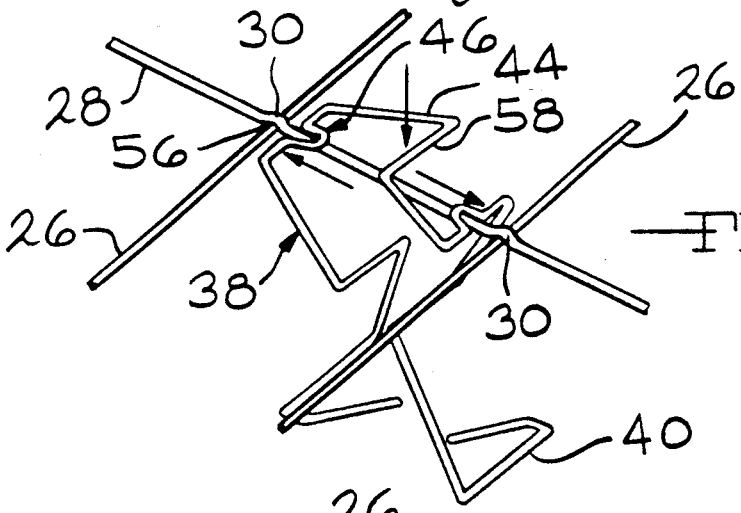
Figure 9:
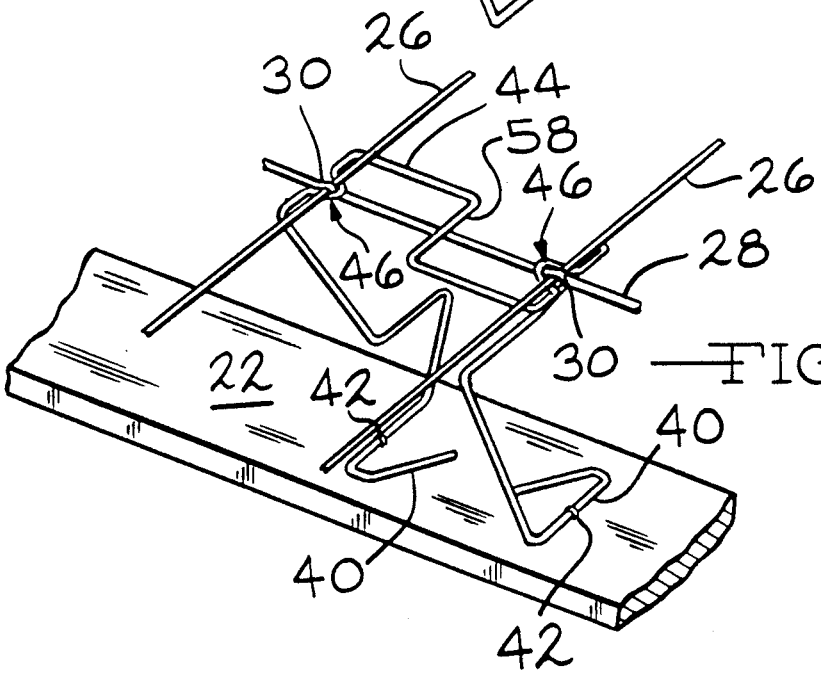

The support deck 14 may also be constructed wherein the long wires 26 and the cross wires 28 are not welded at their crossing point 56. A support deck 14 of this variety is illustrated in FIG. 6. The non-welded wire grid generally exhibits a notched portion 30 at the juncture 56 of the cross wires 28 and long wires 26.

The mattress support deck 14 is supported above the frame 12 by a plurality of spring modules 16. Spring modules 16 may be constructed in numerous varieties. Some common varieties include open top coil springs 36, square top springs 38 and double coil springs (not shown). Each spring module 16 is secured to either an end rail 20 or a cross rail 22 of the frame 12. This securement can be achieved by various methods including the use of staples 42 fastened over a lower portion 40 of each spring module 16.

Figure 5:
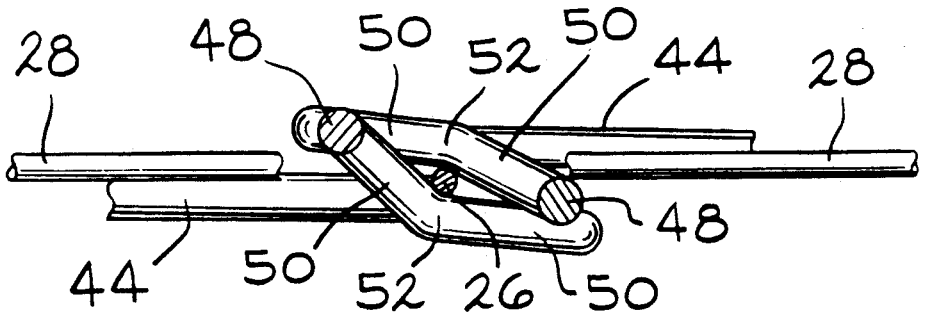
FIG. 5 is a sectional view taken substantially along line 5—5 in FIG. 4 and illustrates the relative positions of the V-shaped sections and the grid wire members.

To secure the support deck 14 a predetermined distance above the frame 12, the spring loaded locking system of the present invention utilizes a pair of oppositely positioned and outwardly open V-shaped sections 46 integrally formed with an upper portion 44 of the spring module 16. Each V-section 46 consists of a vertex 48 and a pair of outwardly extending legs 50. As best seen in FIG. 5, the vertex 48 may be of a raised or lowered orientation relative to the upper portion 44 of the spring module 16. Relative to the orientation of the vertex 48, the legs 50 slope accordingly until merging with the upper portion 44 of the spring module 16. In a central portion of each leg 50, an elbow bend 52 reduces the inclination of the legs 50 to approximately 7° out of horizontal relative to the contact points between the legs 50 and the long and cross wires 26 and 28. In this manner, the legs 50 are prevented from extending an inordinate distance above or below the plane of the support deck 14. As further described below, the elbow 52 also provides for the interference fit between the spring module 16 and the support deck 14

Two different embodiments of the present invention are shown on the two springs represented in the drawings. On the coil springs 36, the V-sections 46 are shown as having opposite orientations (one vertex 48 being upwardly oriented and the other vertex 48 being downwardly oriented). The square top springs 38 are shown as having both vertices 48 oriented upwardly. Another embodiment would be a spring having both vertices 48 in a downward orientation. As all of the embodiments are readily apparent variations of each other, the mounting methods for the embodiments are likewise variations of one another.

Each spring module 16 is mounted between a pair of parallel brace wires. In the figures, the long wires 26 are shown as the brace wires. However, the cross wires 28 can be used as the brace wires instead. To further assist in mounting the spring modules 16 with the support deck 14, a trigger 54 is provided on the terminal end of the upper portion 44 of the spring modules 16.

Figure 2:
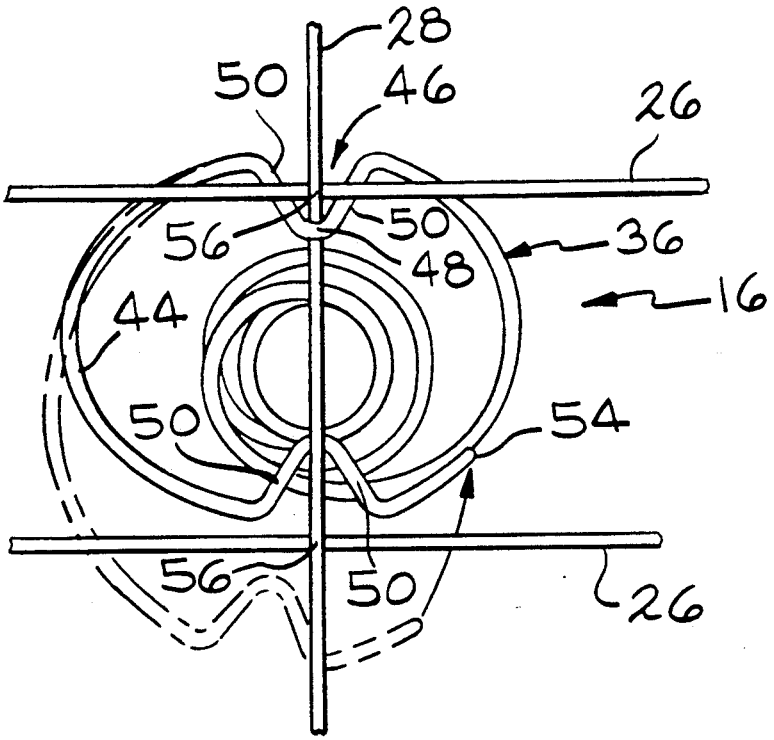
FIGS. 2 and 3 are plan views of a spring module incorporating the present invention and illustrating the method of locking the spring module to the grid network of the support deck.
Figure 3:
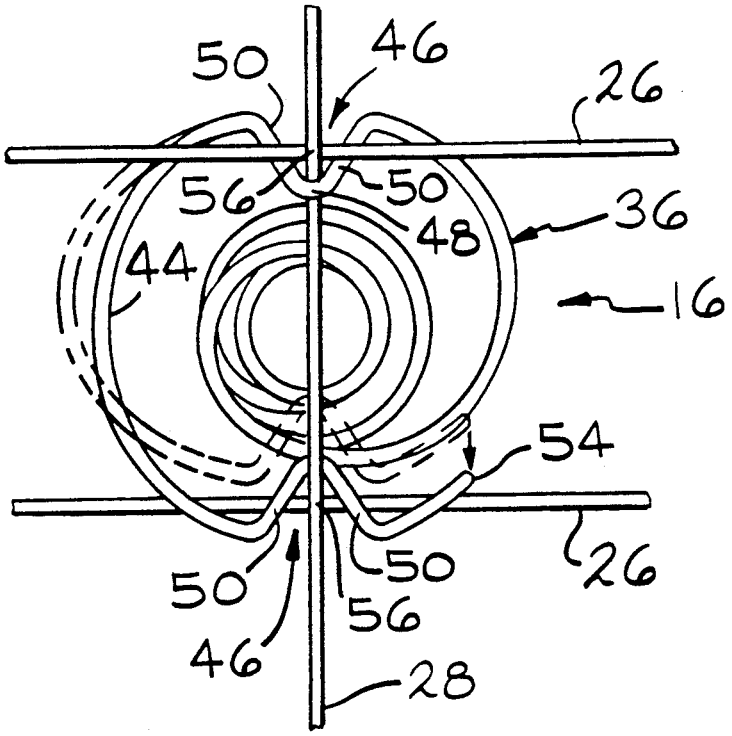

FIGS. 2 and 3 best illustrate the mounting procedure for the coil spring 36 embodiment of the present invention. First, the V-section 46 away from the trigger 54 is positioned upon the crossing point 56 of a long wire 26 and a cross wire 28. In the present embodiment, the vertex 48 is in an upward orientation and contacts the top of the cross wire 28. The legs 50 then slope downwardly crossing beneath the long wire 26 (a brace wire). In this manner, the legs 50 appear to straddle both sides of the cross wire 28 (the connecting wire). Once the first V-section 46 is positioned, the opposing V-section 46, adjacent to the trigger, will be in a displaced position as shown in phantom in FIG. 2. The mounting sequence is completed by exerting a force on the trigger 54 so that the V-section 46 is pulled back and passes beneath the long wire 26 and then releasing the trigger 54 to allow the open end of the V-section 46 and the legs 51 to pass back over the long wire 26. Upper portion 44 is of a desired length and shape so as to bias the paired V-sections 46 apart and provide a sufficient locking force that will secure the V-sections 46 and spring module 16 in place. Typically, a four to ten pound force will be sufficient.

An embodiment having a pair of downwardly oriented V-sections 46 would be mounted in a similar fashion, however, both vertices 48 would be positioned beneath the cross wire 28 and both pairs of legs 50 would cross over the long wires 26.

Figure 4:
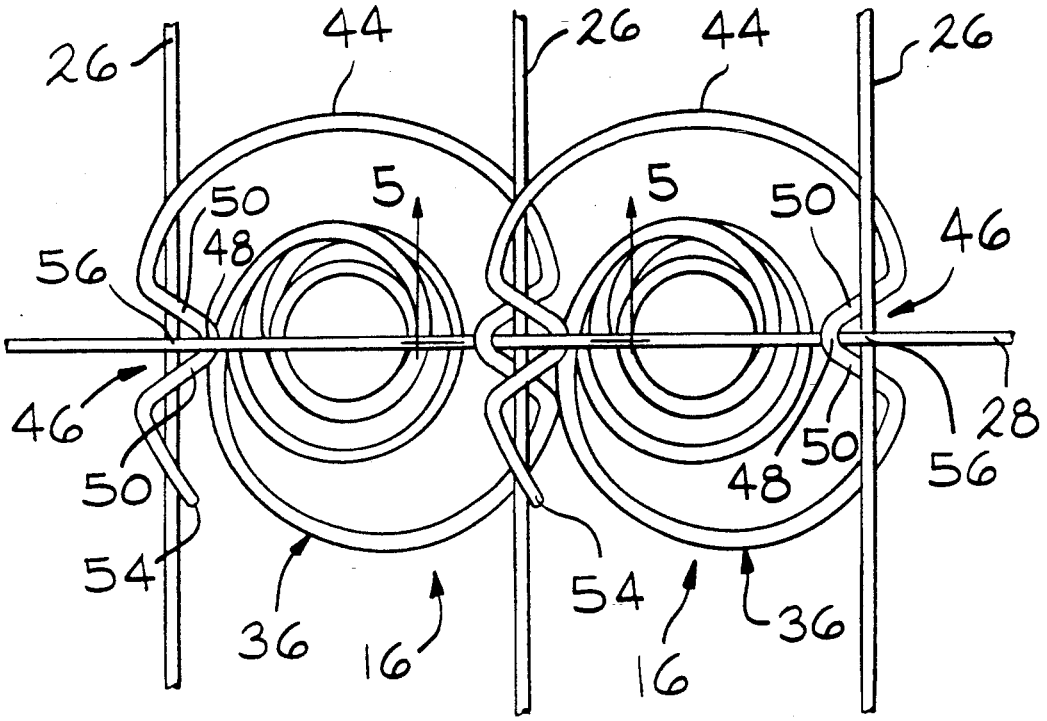
FIG. 4 is a plan view of a pair of spring modules mounted in tandem and sharing a common brace wire.

The alternating orientation described above proves to be a useful embodiment in that a pair of spring modules 16 are enabled to be mounted in tandem and occupy a common welded crossing point 56 and long wire 26 (see FIG. 4). The productivity and material cost advantages of the embodiment become apparent in the cycling time of the welding equipment is halved and the number of long wires 26 required is reduced. When aligned in tandem, the alternating orientation of the V-sections 46 allows the spring modules 16 to be positioned on opposite sides of the common long wire 26. This provides the manufacture with an increased amount of flexibility in constructing box spring assemblies having various supportive constraints. As seen in FIGS. 4 and 5, the tandem positioning of the spring modules 16 does not require the V-sections 46 to contact one another. Spring contact is made only with the long wire 26 and cross wire 28. In this manner, noise from spring to spring contact is eliminated.

The use of the upward vertex 46 and downward sloping legs 50 in conjunction with a welded wire grid support deck 14 allows the spring module 16 to form a protective embrace around the weld sections of the crossing point 56, the effects of which are to minimize fatigue and reduce subsequent weld breakage. This protective embrace also allows the use of non-weldable materials in the matress support deck 14, such as high carbon and high tensile strength spring wire, as further discussed below.

The present invention may also be used in conjunction with a non-welded mattress support deck 14, as seen in FIG. 6. In a non-welded support deck 14, either the cross wires 28 or long wires 26 are formed with notches 30 at the crossing points 56 thereof. FIGS. 6 through 9 also illustrate the embodiment of the present invention incorporating a pair of upwardly oriented V-sections 46 into a square top spring module 16 and a method of installing the spring module 16 with the support deck 14.

A square top spring module 16 having upwardly oriented V-sections 46 is mounted to the support deck 14 by first directing a connecting member 58 of the upper portion 44 of the spring in an upward direction, thus causing the V-sections 46 to move toward one another. Once positioned on the cross wire 28, the connecting member 58 is then returned to its original position causing the V-sections 46 to move outward until the legs 50 pass beneath the long wires 26 and the vertices 48 are in contact with the top of the cross wire 28 at a position adjacent to the notches 30.

While the above description constitutes the preferred embodiments of the present invention, it will be appreciated that the invention is susceptible to modification, variation and change without departing from the proper scope and fair meaning of the accompanying claims.

I claim:

1. A spring loaded locking system for a box spring assembly having a generally horizontal and rectangular frame including end rails, side rails, and cross rails, a generally horizontal mattress support deck disposed a predetermined distance thereabove and including a border wire substantially vertically aligned with the perimeter of said frame, a plurality of substantially parallel cross wire members extending crosswise of said frame and terminating at said border wire and plurality of substantially parallel long wire members extending lengthwise of said frame and terminating at said border wire to form a grid network with said cross wires, said support deck being supported by a plurality of spring modules attached at lower ends to said frame and at upper ends to said support deck by said spring loaded locking system which comprises at least one pair of generally horizontal substantially V-shaped sections oppositely positioned and integrally formed with said upper end of said spring module so as to be spring biased apart, each of said V-shaped sections having a vertex and a pair of legs diverging therefrom and being positioned so that said V-shaped sections straddle one of said deck wires and engage a pair of adjacent deck wires perpendicular to said one deck wire, said biasing of said V-shaped sections thereby providing for said V-shaped sections applying oppositely directed forces to said pair of adjacent deck wires thereby locking said spring module in an interference engagement with said support deck.

2. A spring loaded locking system as set forth in claim 1 wherein said vertices of said V-shaped sections are positioned below said common wire member, said pairs of legs being sloped upward therefrom so as to cross over said pair of adjacent deck wire members.

3. A spring loaded locking system as set forth in claim 1 wherein said vertices of said V-shaped sections are positioned above said common wire members, said pairs of legs being sloped downward therefrom so as to cross under said pair of adjacent deck wire members.

4. A spring loaded locking system as set forth in claim 1 wherein one vertex is positioned below said common wire member, one pair of said legs being sloped upward therefrom and crossing above one of said pair of adjacent deck wire members and wherein the other vertex is positioned above said one deck wire member, said other pair of said legs being sloped downward therefrom and crossing beneath the other one of said pair of adjacent deck wire members.

5. A spring loaded locking system as set forth in claim 1 wherein said spring module is an open top coil spring.

6. A spring loaded locking system as set forth in claim 1 wherein said spring module consists of a pair of deflectable portions and a connective member therebetween, one of said pair of V-shaped sections being integrally formed with the upper end of each of said deflective portions.

7. A spring loaded locking system as set forth in claim 6 wherein said spring module is a square top wire spring.

8. A spring loaded locking system for a box spring assembly having a generally rectangular horizontal frame including side rails, end rails and cross rails, a generally horizontal mattress support deck disposed substantially in a plane a predetermined distance above said frame and including a border wire substantially vertically aligned with the perimeter of said frame, a plurality of substantially parallel long wires extending lengthwise of said frame and being connected to said border wire, a plurality of substantially parallel cross wires extending crosswise of said frame and being connected to said border wire, said long wires and said cross wires being arranged generally perpendicular to each other so as to form a grid network, a plurality of spring modules supporting said deck said predetermined distance above said frame, lower portions of said spring modules being secured to said frame, upper portions securing said spring modules to said deck by said spring loaded locking system which comprises first and second outwardly open generally V-shaped sections being integrally formed with said upper portions of said spring module and interacting with said grid network, said first V-shaped section having a vertex positioned above said plane defined by said deck and contacting one cross wire member, said first V-shaped section further having a pair of legs extending downwardly from said vertex and straddling said cross wire member and passing beneath and contacting a long wire member of said grid network, said second V-shaped section being positioned on said upper portion of said spring module opposite of said first V-shaped section and having a vertex positioned beneath said plane defined by said support deck and contacting said cross wire member, said second V-shaped section further having a pair of legs extending upwardly from said vertex and straddling said cross wire member and passing above and contacting a second long wire member of said grid network, said upper portion of said spring module spring biasing said V-shaped sections apart thereby causing an interference securement between said grid network of said deck and said first and second V-shaped sections.

9. A spring loaded locking system as set forth in claim 8 wherein said spring module is an open top coil spring.

10. A spring loaded locking system as set forth in claim 9 wherein said upper portion of said spring module terminates in a trigger portion for moving said upper portion in a direction against said bias to thereby assist in enabling the engagement and disengagement of said locking system and said deck.

11. A spring loaded locking system as set forth in claim 8 wherein said spring module consists of a pair of deflectable portions and a connective portion therebetween, one V-shaped section being formed in the upper end of each deflectable portion.

12. A spring loaded locking system as set forth in claim 11 wherein said spring module is a square top wire spring.

13. A spring loaded locking system for a box spring assembly comprising:

a generally rectangular frame having side rails, end rails and cross rails;

a generally horizontal mattress support deck vertically aligned and disposed a predetermined distance above said frame, said support deck having a border wire defining the perimeter of said deck, a plurality of substantially parallel long wires extending lengthwise of said assembly and being connected to said border wire, a plurality of substantially parallel cross wires extending crosswise of said assembly and being connected to said border wire, said long wires and said cross wires being transversely positioned to form a crisscross network in said deck;

a plurality of spring modules having lower ends fixably attached to said frame and upper ends for engagement with said grid network of said deck to thereby support said deck with said grid network of said deck to thereby support said deck said predetermined distance above said frame, said upper end of said spring modules including a pair of outwardly open and oppositely positioned V-shaped sections being spring biased apart by said upper end, said V-shaped sections each including a vertex and a pair of diverging legs, a first wire member of said support deck being in contact with said vertices and being straddled by said legs, each of said legs also crossing and contacting one of a pair of substantially parallel brace wires positioned transversely to said first wire member, said vertices and said legs coacting with said first wire member and said brace wires in an interference engagement to thereby lock said support deck into a fixed position on said frame.

14. A spring loaded locking system for a box spring assembly as set forth in claim 13 wherein said common wire member is one of said cross wires and said brace wires are a pair of said long wires.

15. A spring loaded locking system for a box spring assembly as set forth in claim 13 wherein said common wire member is one of said long wires and said brace wires are a pair of said cross wires.

16. A spring loaded locking system for a box spring assembly as set forth in claim 13 wherein said spring module is an open top coil spring.

17. A spring loaded locking system for a box spring assembly as set forth in claim 13 wherein said upper end further includes a trigger portion for enabling movement of said upper end against said bias thereby facilitating engagement between said V-shaped sections and said deck.

* * * * *